United States Patent [19]

Coffin

[11] 4,126,521

[45] Nov. 21, 1978

[54] METHOD OF COATING METAL SURFACES

[75] Inventor: Harry S. Coffin, King of Prussia, Pa.

[73] Assignee: Computer Peripherals, Inc., Rochester, Mich.

[21] Appl. No.: 843,385

[22] Filed: Oct. 19, 1977

[51] Int. Cl.[2] ..... C25D 5/02; C25D 17/06

[52] U.S. Cl. ..... 204/15; 204/297 W

[58] Field of Search ..... 204/15, 297 W

[56] References Cited

U.S. PATENT DOCUMENTS

| | | | |
|---|---|---|---|
| 2,784,151 | 3/1957 | Topelian | 204/23 |
| 3,257,308 | 6/1966 | Cottom | 204/297 W |
| 3,414,502 | 12/1968 | Porrata et al. | 204/15 |
| 3,527,679 | 9/1970 | Barile | 204/15 |
| 3,553,096 | 1/1971 | Coir | 204/297 W |

*Primary Examiner*—T. M. Tufariello

*Attorney, Agent, or Firm*—J. T. Cavender; Wilbert Hawk, Jr.; Richard W. Lavin

[57] ABSTRACT

A method and apparatus is disclosed for plating a selected portion of the surface of an article in which the non-plating surfaces of the article are covered by a non-porous elastic material to which pressure is applied to provide an liquid-tight seal between the elastic material and the mating surface of the article. An electrical conductor extending through the elastic material contacts the article allowing current to pass through the article when placed in a plating bath for depositing on the selected surface a metallic coating such as chromium. The article is mounted within a carrier composed of the non-porous elastic material which is formed to cover all of the non-plating surfaces of the article. The carrier is positioned within a fixture in which is provided means to apply pressure on the carrier thereby providing the liquid-tight seal between the carrier and the article.

4 Claims, 4 Drawing Figures

METHOD OF COATING METAL SURFACES

BACKGROUND OF THE INVENTION

The present invention relates to a method and apparatus for plating on selective surfaces of an article a metallic coating, and more particularly, to a method and apparatus for chrome plating selected surfaces of a magnetic transducer.

The present methods for plating selected surfaces of an article include the application of a wax coating over the non-plating surfaces of the article, thereby requiring the stripping of the wax coating from the article either by scraping or the application of a cleaning solution, both of which involve high labor cost. In those applications where the surfaces covered by the wax coating are normally not affected by the wax or the cleaning solution, the above method provides acceptable results. In the case of a magnetic transducer or other types of electronic devices in which the non-plating surfaces of the article contain or are in communication with electronic circuits or other types of electrical elements which would be adversely affected when in contact with the plating solution, the wax coating or the cleaning solution used to remove the wax coating, present plating methods have proven inadequate. Other articles which are similarly affected include those having a metal and non-metal construction where the non-metal portion would be adversely affected by the plating solution, the wax coating or the cleaning solution. In order to overcome these drawbacks, the method and apparatus of the present invention has as a principal object, the provision of plating selected surfaces of an article of the type described above without adversely affecting the non-plated portion of the article or its function. It is a further object of this invention to provide a method and apparatus for plating selected surfaces of an article which is relatively simple in its operation together with low labor costs.

SUMMARY OF THE INVENTION

These and other objects of the invention are fulfilled by mounting the article to be plated within a boot-type enclosure or other type of carrier which is constructed of a non-porous elastic material formed to cover those surfaces of the article which are not to be plated while exposing those surfaces of the article which are to be plated. An electrical conductor located within the carrier makes contact with a surface of the article. The carrier is mounted within a supporting fixture in which means are supplied to exert pressure on the outside surface of the carrier thereby moving the carrier against the surfaces of the article to provide a liquid-tight seal between the wall structure of the carrier and the mating surface of the article. The fixture is inserted into a plating bath wherein a current is passed through the conductor and the article resulting in the plating of the exposed surface of the article.

BRIEF DESCRIPTION OF THE DRAWINGS

These and other objects of the invention will become apparent from a consideration of the following detailed description and claims taken together with the accompanying drawings in which;

DETAILED DESCRIPTION

Figure 1:
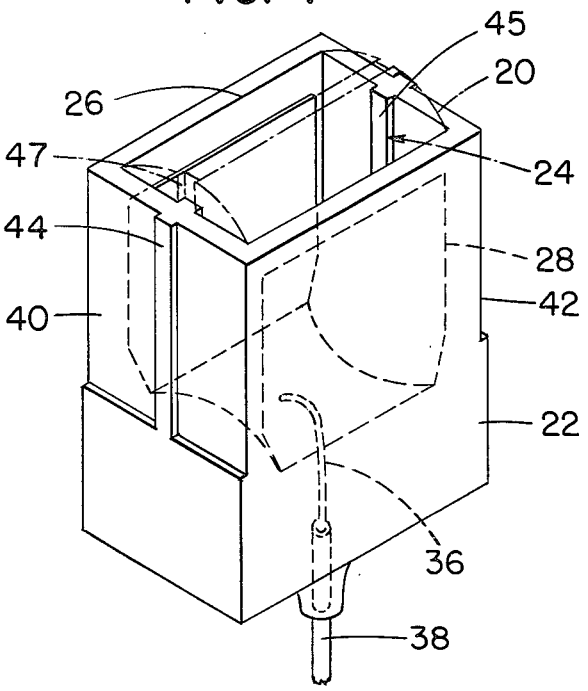
FIG. 1 is a perspective view of the carrier showing the location of the conductor element together with a magnetic transducer mounted within the carrier.
Figure 2:
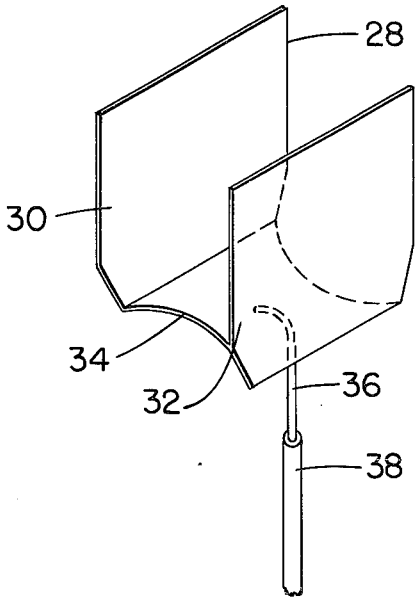
FIG. 2 is a perspective view of the conductor element.

Referring to FIG. 1, there is illustrated by way of example in phantom line a magnetic transducer 20 positioned within a boot-type support member or carrier 22 wherein the head portion 24 of the magnetic transducer 20 is exposed, the head portion comprising the only surface of the transducer 20 required to be plated. The carrier 22 is composed of a non-porous, non-conducting elastic material such as rubber or other type of compatible material which can function in a plating bath. The carrier 22 is formed with an opening or cavity 26 which conforms to the outer dimensions of the magnetic transducer 20 such that when the magnetic transducer is inserted within the cavity 26, only that portion of the magnetic transducer which is required to be plated is exposed which in the present embodiment is the head portion 24. Located within the cavity 26 is a conductor plate 28 (see also FIG. 2) having a pair of parallel side wall portions 30, 32 which when located within the cavity 26 of the carrier 22 will make contact with the sides of the magnetic transducer 20. The utilization of wall portions 30, 32 in the conductor plate 28 for contacting the sides of the transducer 20 provides a large contact area which overcomes any irregularity in the abutting sides of the transducer. The conductor plate 28 may be composed of any electrical conductor material such as copper. Secured to a floor portion 34 of the conductor plate 28 in any well-known manner such as soldering is a conductor element 36 through which current will be transmitted to the conductor plate 28. The conductor plate 28 and the conductor element 36 are mounted within the carrier 22 in any manner such as molding. In the present embodiment, the conductor element 36 extends outwardly through the bottom of the carrier 22 and is protected from the plating solution by a non-porous sleeve member 38 in a manner well-known in the art. As shown in FIG. 1, the end portions 40 and 42 of the carrier 22 are recessed to provide a ribbed portion 44 extending along the end portions of the carrier in a vertical direction. A similar ribbed portion 45 is formed on the side of the cavity 26 adjacent the ribbed portion 44 to fill a corresponding slot 47 located in the transducer 20. In those instances where the transducer 20 does not contain a slot 47, the ribbed portion 44, 45 would not be required. As will be described more fully hereinafter, the ribbed portion 44 will allow the ribbed portion 45 to fill the transducer slot 47 completely when pressure is applied to the ribbed portion 44.

Figure 3:
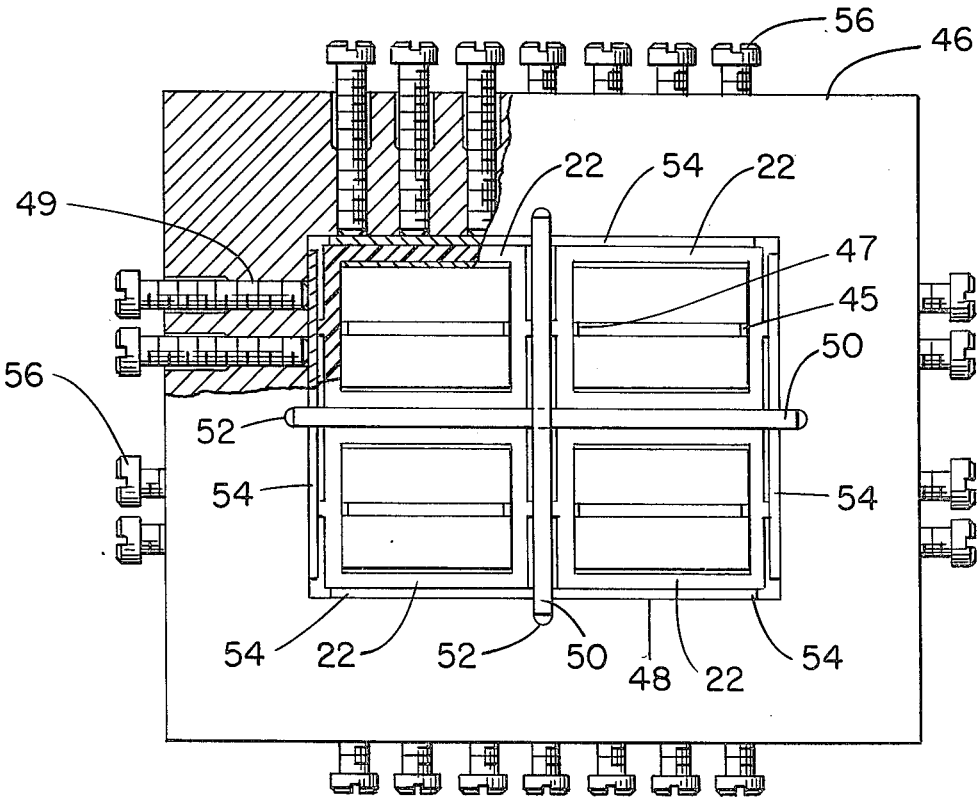
FIG. 3 is a plan view of the support fixture with a portion cut away showing the screw members engaging the pressure plates.

Referring to FIG. 3, there is shown a fixture 46 utilized in the present embodiment which supports four of the carriers 22 for use during the plating operation. The fixture 46 includes a center opening 48 which is divided into four sections by a pair of slidably mounted partition members 50 which are positioned within slots 52 located in the fixture 46. Positioning of the carriers 22 within the opening 48 will result in two of the sides of each carrier abutting the partition members 50. The remaining two sides of the carrier will abut a pair of pressure plates 54 which are slidably positioned within the opening 48. The pressure plates 54 are constructed to have a length slightly less than the length of the abutting side of the carrier 22 to facilitate their inward movement without interfering with the movement of the adjacent pressure plate.

Bearing against the pressure plates 54 are a plurality of screw members 56 which are threaded through tapped holes 49 located in the fixture 46 and which are adapted for movement against the pressure plates 54. Movement of the pressure plates 54 against the sides of the carrier 22 under the action of the screw members 56 will result in the sides of the carrier 22 forming a liquid-tight relationship with the abutting sides of the magnetic transducer 20. During the movement of the pressure plates 54 against the sides of the carrier 22, the carrier sides will be compressed thereby forcing portions of the sides of the carrier 22 to fill the space between the magnetic transducer 20 and the carrier 22 thereby preventing any of the plating solution from seeping down between the sides of the magnetic transducer 20 and the carrier 22.

Figure 4:
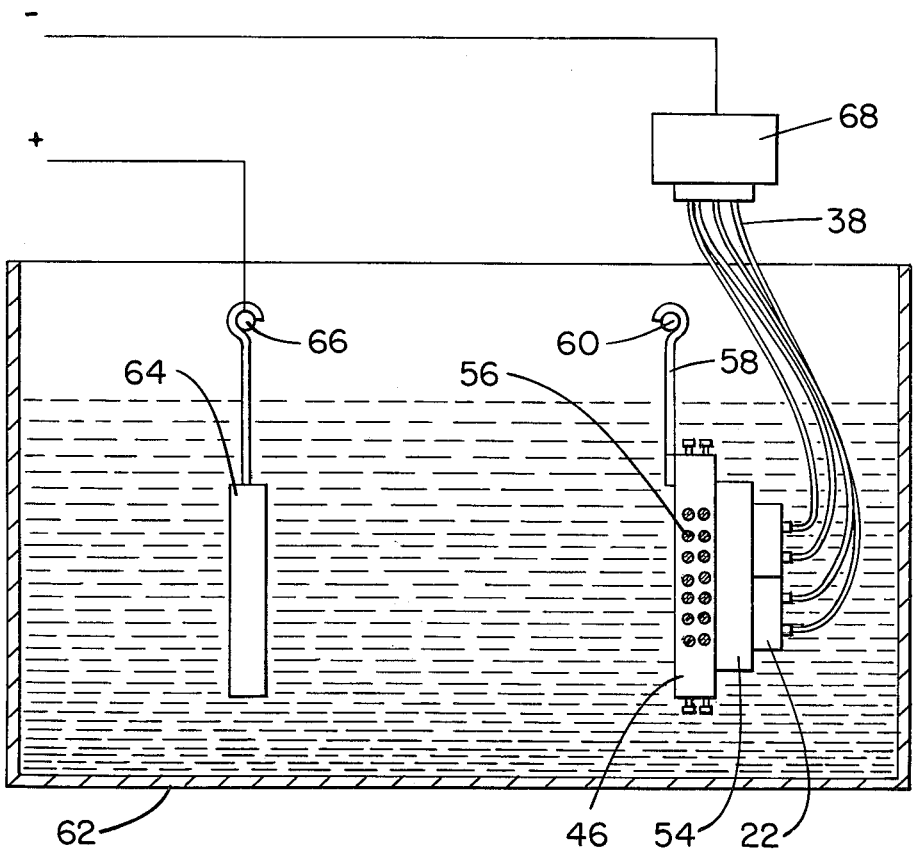
FIG. 4 is a cross-sectional view of a plating bath showing the location of the support fixture during a plating operation.

As shown in FIG. 4, the fixture 46 is secured to a hanger member 58 and hung from a supporting bar 60 located in a chromium plating bath 62. The bath 62 also includes an anode 64 which is also supported on a support bar 66. Both the anode 64 and the fixture 46 are suspended in a chromium bath which may be of any known industrial or engineering type. In the present embodiment, the bath contains 2.06 lbs. of chromic oxide per gallon of water or approximately 25% by weight of the solution. The bath is maintained at a temperature of between 130° to 135° F. The anode 64 is connected to a positive potential while the fixture 46 through the conductor elements 36 is connected to a negative potential through a connector box 68 (FIG. 4). The plating operation is carried out for thirty hours at a current density of 3.2 Amps. per square inch of surface area to be plated at an approximate potential of 3 volts. At the completion of the plating operation, the fixture 46 is removed from the bath 62 with the subsequent removal of the carriers 22 from the fixture 46 by releasing the pressure exerted on the pressure plates 54 by the screw members 56. The fixture 46 is then available for the plating of four more magnetic transducers 20 in the manner described above.

While the chromium plating of a magnetic transducer has been described, it will of course be understood that the invention is applicable to a wide variety of similarly constructed objects. Further, any type of non-porous elastic material can be used for the construction of the carrier 22 which prevents the plating solution from penetrating the carrier. Additionally, while there has been disclosed the use of screw members 56 coacting with pressure plates 54 as a means to apply pressure to the carrier 22, it is obvious that the present invention requires only that the carrier provide a liquid-tight seal with the article to prevent the plating solution from reacting those parts of the article not required to be plated or which would destroy the function of the article.

While the invention has been specifically described with regard to chromium plating, it is obvious that the present method together with the apparatus could be used with any other type of plating solution. Furthermore, many changes and details of the preferred embodiment may be made without departing from the spirit and scope of the present invention and, hence, such invention is not intended to be limited beyond that as defined in the appended claims.

What is claimed is:

1. A method for forming a metal coating on the head portion of a magnetic transducer comprising the steps of a. mounting an electrical conductor within a holder formed of a non-porous, non-conducting elastic material;
b. mounting a magnetic transducer within the holder with the non-head portion of the transducer in contact with the electrical conductor and the holder while exposing only the head portion of the transducer;
c. mounting the holder in a support member having movable members engaging the sides of the holder;
d. mounting a plurality of actuating members in the support member engaging said movable members;
e. operating said actuating members to move said movable members against the sides of said holder to provide a liquid-tight seal between the non-head portion of the transducer and the holder;
f. making the electrical conductor the cathode in a chromium bath having an anode;
g. passing current between the electrical conductor and the anode;
h. and removing the transducers from the holder.

2. The method as claimed in claim 1 and further characterized in that the said current is maintained at a current density of approximately 3.2 Amps. per square inch of surface to be coated under a potential of approximately 13 volts.

3. The method as claimed in claim 1 and further characterized in that the chromium bath comprises a chromic oxide solution in which the chromium oxide content comprises approximately 25% by weight of said solution and said solution is maintained at a temperature ranging from approximately 130° to 135° F.

4. A method for forming a chromium coating on the head portion of a magnetic transducer comprising the steps of a. moulding an electrical conductor to the inside walls of the cavity portion of a boot type carrier formed of a non-porous, non-conductive elastic material;
b. positioning a magnetic transducer within the cavity portion of the carrier in contact with the electrical conductor wherein the cavity portion of the carrier covers the body portion of the magnetic transducer while exposing only the head portion of the transducer;
c. mounting the carrier in a support member having movable wall members each engaging a side wall of the carrier;
d. mounting a plurality of actuating mambers in the support member engaging the movable wall members adjacent the top edge of the carrier surrounding the head portion of the magnetic transducer;
e. operating said actuating members to move said movable wall members against the sides of the magnetic transducer compressing the sides of the carrier against the sides of the magnetic transducer to provide a liquid-tight seal between the top edge of the carrier and the magnetic transducer adjacent the head portion of the transducer;
f. mounting a plurality of actuating members in the support member engaging said movable member;
g. making the electrical conductor the cathod in a chromium bath having an anode;
h. passing current between the electrical conductor and the anode;
i. disabling the actuating members from engagement with the movable wall member;
j. and removing the transducer from the carrier.

* * * * *